US006447405B1

(12) United States Patent
Chen

(10) Patent No.: US 6,447,405 B1
(45) Date of Patent: Sep. 10, 2002

(54) GOLF CLUB HEAD

(75) Inventor: Tao-Ming Chen, Kaohsiung Hsien (TW)

(73) Assignee: Chien Ting Precision Casting Co., Ltd., Ping Tung (TW)

( * ) Notice: Subject to any disclaimer, the term of this patent is extended or adjusted under 35 U.S.C. 154(b) by 0 days.

(21) Appl. No.: 09/641,525

(22) Filed: Aug. 21, 2000

(51) Int. Cl.[7] ..... A63B 53/04
(52) U.S. Cl. ..... 473/328
(58) Field of Search ..... 473/290, 291, 473/292, 324, 345, 346, 344, 349, 328; D21/733, 752

(56) References Cited

U.S. PATENT DOCUMENTS 1,283,568 A * 11/1918 Sampson
1,541,126 A * 6/1925 Dunn
3,810,631 A * 5/1974 Braly
4,065,133 A * 12/1977 Gordos
4,498,673 A * 2/1985 Swanson
4,850,593 A * 7/1989 Nelson
5,288,079 A * 2/1994 Katayama
5,326,105 A * 7/1994 Fenton
5,419,556 A * 5/1995 Take
5,611,741 A * 3/1997 Schmidt
5,674,136 A * 10/1997 Gorse
5,785,609 A * 7/1998 Sheets
5,800,281 A * 9/1998 Gilbert
5,989,134 A * 11/1999 Antonious
6,045,453 A * 4/2000 Jenkins
6,048,278 A * 4/2000 Meyer
6,120,389 A * 9/2000 Kruse

* cited by examiner

*Primary Examiner*—Sebastiano Passaniti
(74) *Attorney, Agent, or Firm*—Rosenberg, Klein & Lee

(57) ABSTRACT

A golf club head includes a hollow head, a hitting face formed in a front side of the hollow head, a neck formed on top of the hollow head for a golf club to fit in tightly, a sole formed in lower end of the hollow body, and a curved face portion formed in the sole and provided with a front end curved up forward and extending along a lower edge of the hitting face. So the lower edge of the hitting face may not touch the ground to strike into the grass lawn to dig up the ground and grass lawn when a golfer swings and hits a golf ball with the golf club head.

3 Claims, 3 Drawing Sheets

GOLF CLUB HEAD

BACKGROUND OF THE INVENTION

This invention relates to a golf club head, particularly to one provided with a shape possible to avoid striking up a ground block or a piece of grass lawn when golfer is hitting a golf ball.

In playing golf, the most important matter in hitting a golf ball is stability and comfortableness so as to let the golf ball to fly smoothly to the expected direction and distance. But common conventional golf club heads shown in FIGS. 4 and 5 have a body 10, a hitting face 101 formed in a front side of the body 10, a neck 102 formed on top for the lower end of a golf club to fit in tightly. The body 10 has a sole 103 shaped to gradually sloping down, and the sole 103 is the lowest point connected to the lower edge of the hitting face 101 so as to let the hitting face hitting a golf ball smoothly.

When the conventional golf club head just described practically hits a golf ball, the lower edge of the hitting face 101 (or the lowest point of the sole 103) may strike into a grass lawn in hitting a golf call, as the sole 103 is located below the hitting face 101. Then the golf club head may dig up a piece of ground block and of grass lawn at the same time. Therefore, the vibration and resistance produced by the ground block and the grass lawn may affect the stability and force of the golf club. In addition, if the golf club head strikes the ground too deep, the hand of a golfer may receive a large shock and get hurt. Besides, the dug up ground and the grass lawn may form a hole in the ground, causing trouble in maintaining the grass lawn.

SUMMARY OF THE INVENTION

The objective of the invention is to offer a golf club head improved, having a hitting face in the front side of the club head, a neck formed on top, and a curved face portion formed in a sole and extending from the front end of the sole curved up forward and along under the hitting face. Thus, when the golf club head hits a golf ball, the lower edge of the hitting face does not touch the ground to strike into the grass lawn so as not to strike up a piece of ground or of grass lawn, without causing vibration or resistance to affect stability of the golf club, or subsequent sports harm.

BRIEF DESCRIPTION OF THE DRAWINGS

This invention will be better understood by referring to the accompanying drawings, wherein.

DETAILED DESCRIPTION OF THE PREFERRED EMBODIMENT

Figure 1:
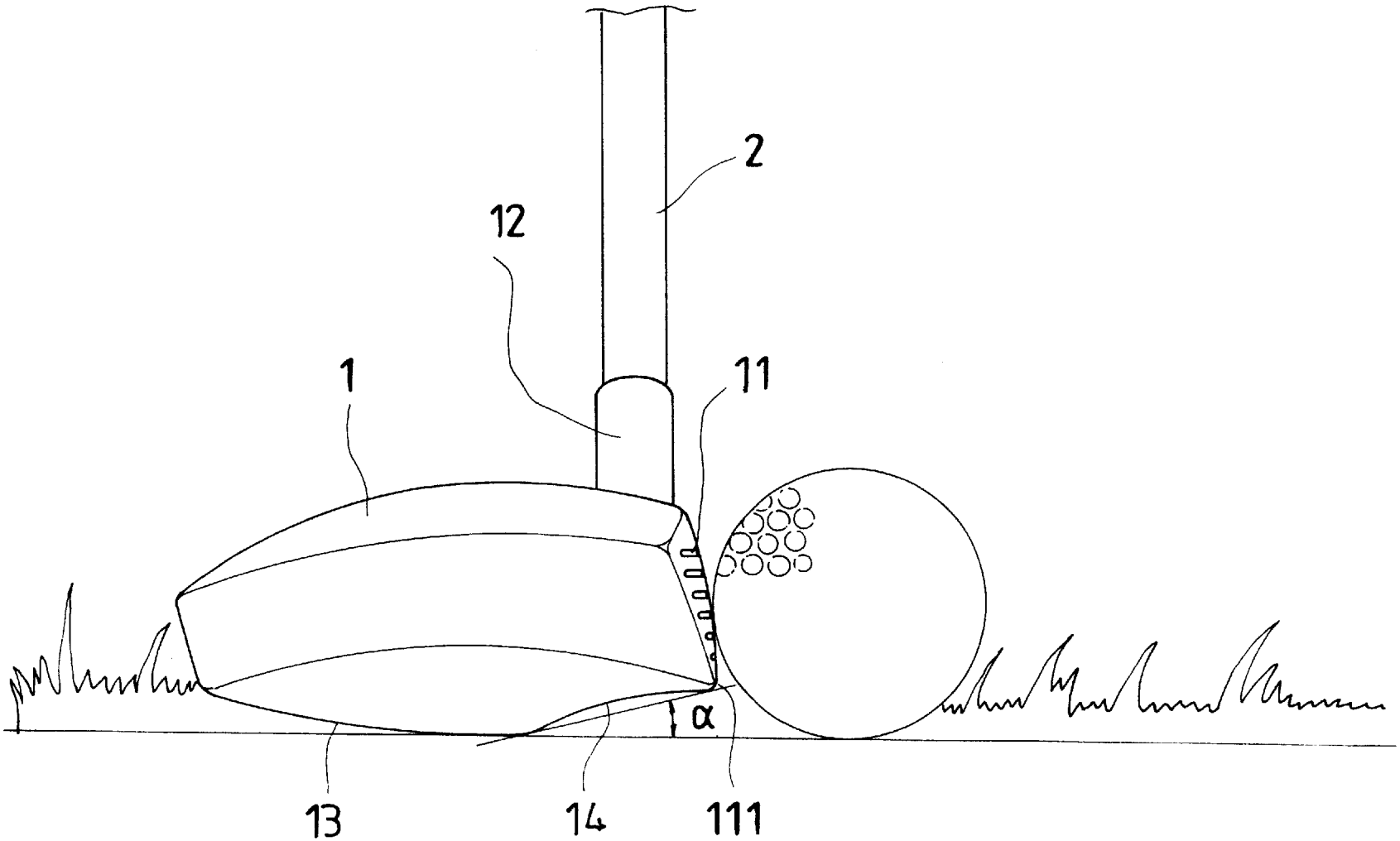
FIG. 1 is side view of a golf club head under hitting condition of the present invention.
Figure 2:
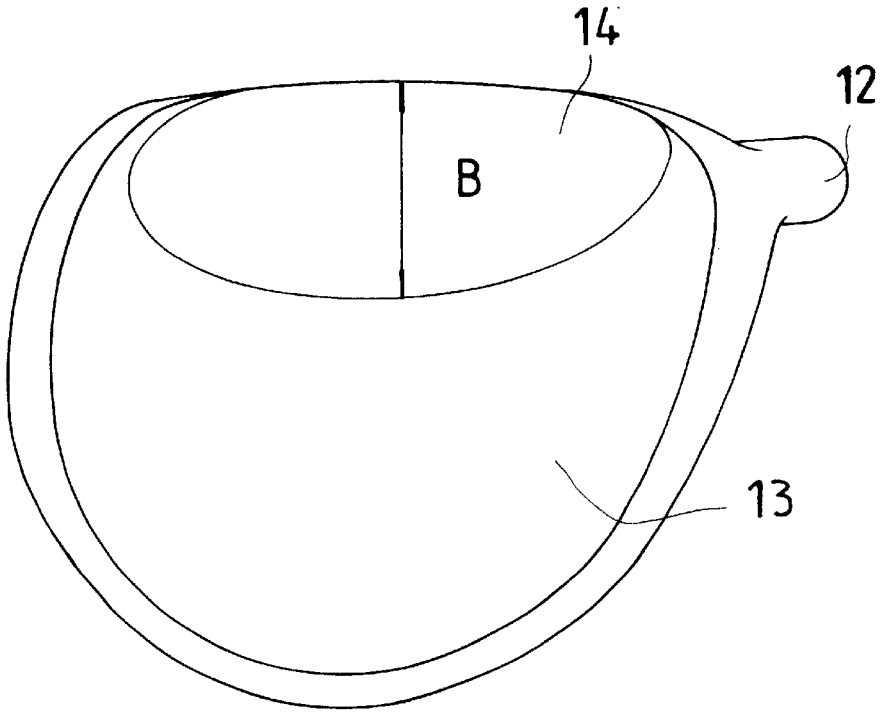
FIG. 2 is an upper view of the golf club head of the present invention.
Figure 3:
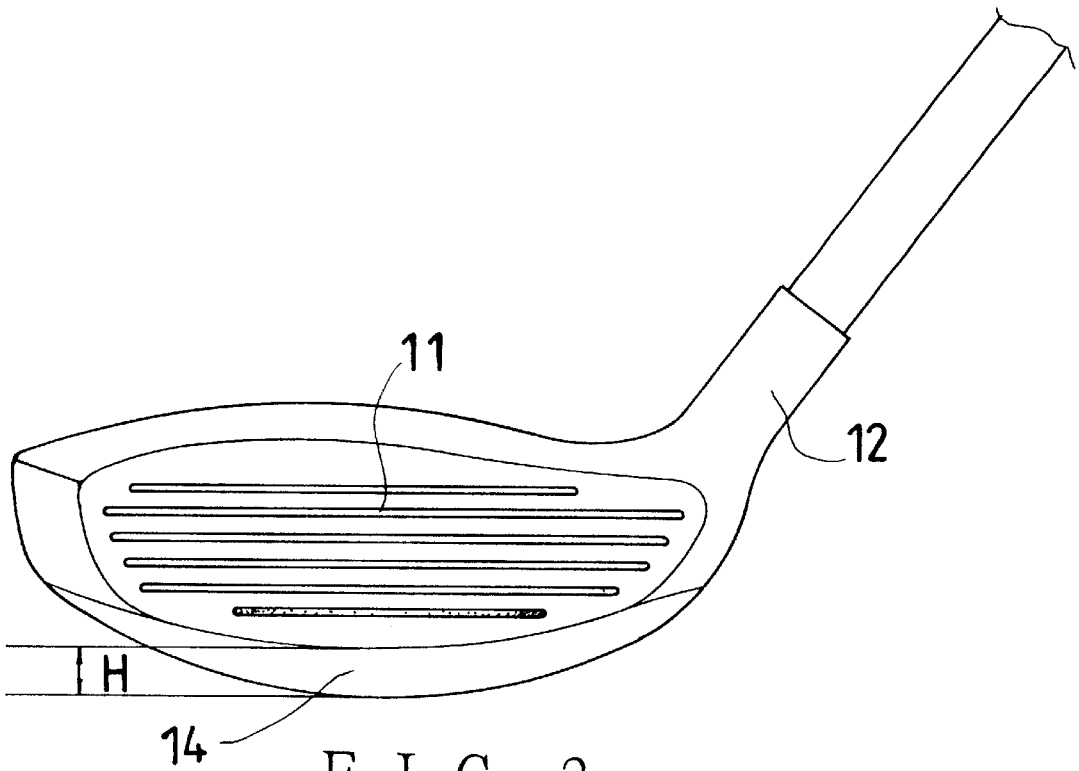
FIG. 3 is a front view of the golf club head of the present invention.
Figure 4:
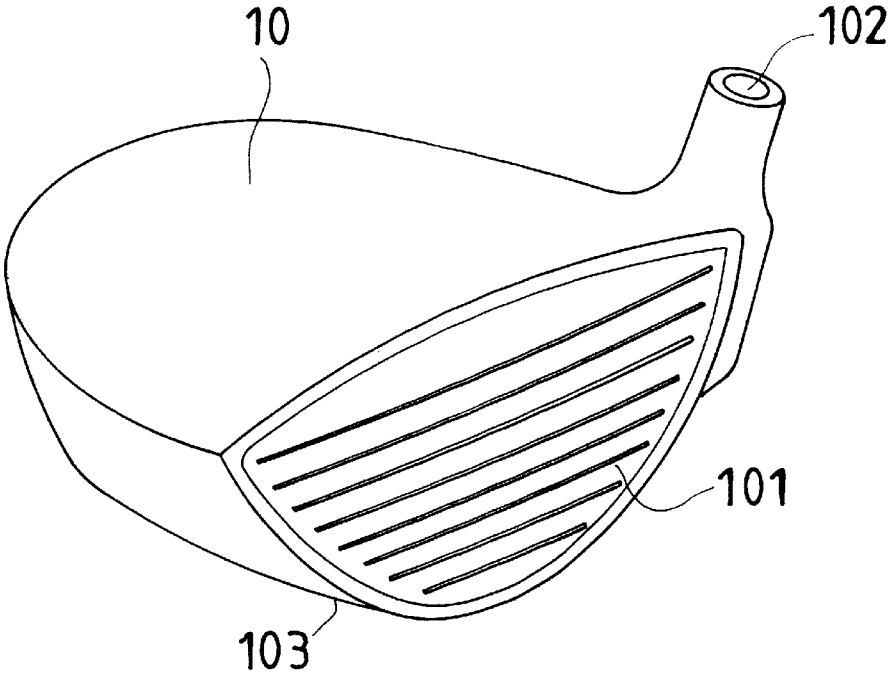
FIG. 4 (PRIOR ART)
FIG. 4 is a perspective view of a conventional golf club head.
Figure 5:
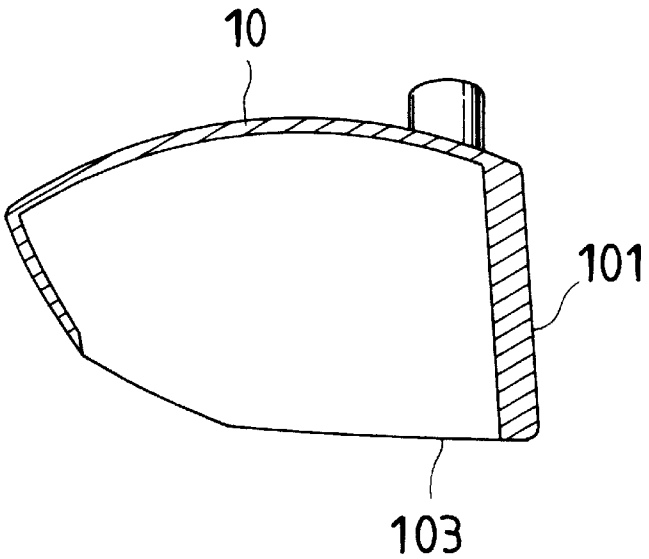
FIG. 5 (PRIOR ART)
FIG. 5 is a side cross-sectional view of the conventional golf club head.

A preferred embodiment of a golf club head in the invention, as shown in FIGS. 1, 2 and 3, includes a hollow body 1, a hitting face 11 formed in a front side of the body 1, a neck 12 formed on top of the body 1 for a lower end of a golf club 2 to fit tightly therein, a sole 13 formed in a lower side of the body 1 and having a front end curved up forward and then extending rearward along a lower edge 111 of the hitting face to reach a curved face portion 14. The curved face portion 14 has a width (B) 1–3 cm from a front side to a rear side and an angle $\alpha$, preferably 18°–22°, formed between itself and the ground level, and a height H from the ground being 0.6–1.2 cm.

In swinging and hitting a golf ball with the golf club head, the lower edge 111 of the hitting face 11 may not touch the ground owing to the curved face portion 14 formed in the sole 13, as shown in FIG. 1, preventing the lower edge 111 of the hitting face 11 from striking into the grass lawn to dig up a piece of ground and of the grass lawn so as to permit the golf ball smoothly hit.

As understood from the description, provision of the curved portion provided in the front end of the sole can let the lower edge of the hitting edge not touch the ground as to strike up the grass lawn or the ground. Therefore, vibration of hitting a golf ball only occur at the moment of hitting, with no other vibration so that stability of hitting the golf ball and the force of hitting can be kept, letting the golf ball fly farther and not causing sports harm to the hand of a golfer.

What is claimed is:

1. A golf club head comprising:

a body having leading front and trailing rear ends and an intermediate part extending longitudinally therebetween;

a neck extending upward from said body for engaging a golf club shaft;

a hitting face formed on said leading front end of said body; and, a sole extending longitudinally from said hitting face to said trailing rear end of said body beneath said intermediate part of said body, said sole having a trailing portion, and a leading portion extending longitudinally upward therefrom in a concavely tapered manner to said hitting face for maximizing clearance above an underlying surface when said hitting face strikes a ball.

2. The golf club head as recited in claim 1 wherein said leading portion of said sole has a longitudinal width dimension defined between said trailing portion of said sole and said hitting face within an approximate range of 1–3 cm and a taper height dimension defined at said hitting face within an approximate range of 0.6–1.2 cm.

3. A gulf club head comprising:

a body having a leading front end, a trailing real end, and an intermediate part extending longitudinally therebetween;

a neck extending upward from said body for engaging a golf club shaft;

a hitting face formed on said leading front end of said body; and, a sole extending longitudinally from said hitting face to said trailing rear end of said body beneath said intermediate part of said body, said sole having a trailing portion, and a leading portion extending longitudinally upward therefrom in a concavely tapered manner to said to said hitting face for maximizing clearance above an underlying surface when said hitting face strikes a ball, said leading portion of said sole having a longitudinal width dimension defined between said trailing portion of said sole and said hitting face within an approximating range of 1–3 cm and a taper height dimension defined at said hitting face within an approximating range of 0.6–1.2 cm, said leading portion of said sole including first and second edges offset by said longitudinal width dimension, said first and second edges delineating an incline angle within an approximating range of 18–22 degrees.

* * * * *